United States Patent [19]

Easter

[11] Patent Number: 4,860,479

[45] Date of Patent: Aug. 29, 1989

[54] WRAPAROUND COVER FOR GUNS DURING FIELD USE

[76] Inventor: Michael D. Easter, 840 J St., Penrose, Colo. 81240

[21] Appl. No.: 142,193

[22] Filed: Jan. 11, 1988

[51] Int. Cl.[4] ..... B65D 85/00

[52] U.S. Cl. ..... 42/96; 206/317; 33/244

[58] Field of Search ..... 42/96; 206/317; 150/52 R; 224/913

[56] References Cited

U.S. PATENT DOCUMENTS

| | | | |
|---|---|---|---|
| 35,456 | 6/1862 | Leverich | 42/96 |
| 2,364,340 | 12/1944 | Bogg, Jr. | 150/52 R |
| 2,599,689 | 6/1952 | Brelsford | 42/96 |
| 2,872,960 | 2/1959 | Kolpin | 42/96 |
| 2,932,334 | 4/1960 | Steen | 150/52 R |
| 4,055,287 | 10/1977 | Champenois, Jr. | 150/52 R |
| 4,674,787 | 6/1987 | DeVera | 150/52 R |

FOREIGN PATENT DOCUMENTS

| | | | |
|---|---|---|---|
| 22346 | 6/1921 | France | 42/96 |

*Primary Examiner*—Deborah L. Kyle
*Assistant Examiner*—Michael J. Carone
*Attorney, Agent, or Firm*—Klaas & Law

[57] ABSTRACT

A new protective covering device (14) for guns (16) with telescopic sights providing protection for the telescopic sight, trigger and action while the gun (16) is being carried in the field. The covering device (14) is comprised of a single expanse of flexible waterproof material (14) having sufficient size to envelope the midsection of a gun (16), to include the telescopic sight, action and trigger. Attached to the flat upper edge of flexible material (4) are one or more straps (10A, 10B) extending outward and having a releasable connector device (8) attached to the free end providing means for attaching the covering device (14) to the telescopic sight of a sun (16).

Integral with the lower portion of the covering device (14), is an elastic member (6) defining a circuitous and somewhat encircling route adjacent to and parallel with a skirted edge (12). As the covering device (14) is wrapped around and closed over the midsection of a gun (16), the integral elastic member (6) is stretched into tension and provides a retaining and sealing of the flexible material (4) about the weather sensitive midsection of a gun (16). The skirted edge (12) participates in providing the desired protection while conveniently serving as a means for the user to grasp the covering device (14) in order to open and close the covering device (14).

13 Claims, 1 Drawing Sheet

WRAPAROUND COVER FOR GUNS DURING FIELD USE

BACKGROUND

1. Field Of Invention

This invention relates to a protective covering device for guns and more particularly to a new wraparound protective cover providing protection for guns with telescopic sights while being carried in the field.

2. Description Of Prior Art

Heretofore protective coverings for guns have been primarily confined to providing protection only when the gun is not being used. These coverings envelop the gun in it's entirety providing protection for the whole gun, consequently making quick access for firing out of the question. Furthermore if a person did remove a full length cover in order to fire the gun he would have to drop the cover on the ground as no means are provided to keep the cover attached to the gun.

Still another cover provides protection and camouflaging to the gunstock and barrel while leaving the telescopic sight and action area of the gun exposed.

Objects and Advantages

Therefore there exists a need for a cover that provides protection for the critical midsection of a gun, including the action, telescopic sight and trigger, while the gun is being carried in the field. Such a cover should provide protection against rain, snow, dust, twigs and the like. Moreover the cover should be quick and easy to open allowing the gun to be fired when needed while simultaneously remaining attached to the gun preventing loss or droppage of the cover. A still further object is that the cover be easily opened and closed by a person wearing gloves and using only one hand to grasp the cover, allowing the other hand to hold the gun. It is desirable that the cover be self-sealing and self-adjusting with a minimum amount of effort. Another feature would be reversibility allowing the same cover to be used on both right and left handed guns. The additional features of easy attachment and detachment to and from the gun are also novel objectives. Then a still further object would be a cover that could be folded and conveniently carried in a clothing pocket when not needed on the gun. Yet other objects of the invention would be to provide a cover that is lightweight, durable, inexpensive and attractive.

Other objects and advantages of my invention will become apparent from the following description and the accompanying drawings.

Figure 1:
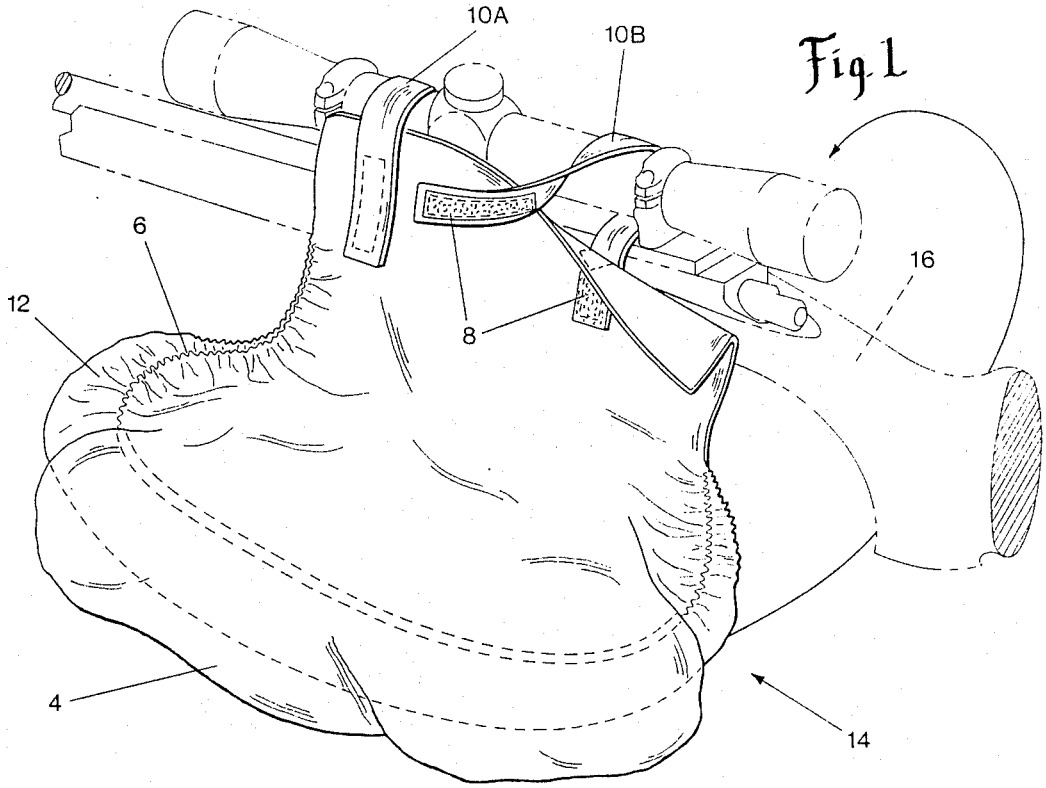
FIG. 1 is a perspective view of my invention showing the cover in the open position.

4 fabric of cover
6 elastic
8 Velcro TM tape
10A, 10B attachment straps
12 skirt
14 cover
16 gun

Description of Invention

As illustrated in FIG. 1 the gun covering device 14 consists of a single expanse of flexible fabric 4, preferably nylon with a urethane coating for waterproofing, however any textile material having properties which result in a flexible waterproof fabric could be used.

The gun cover 14, as shown in FIG. 1, can be visually divided into two different areas, an upper and lower. The upper area is characterized by flat edges with two rather square corners and two straps 10A and 10B extending squarely away from the fabric edge. Straps 10A and 10B are permanently connected to the fabric on one end. A releasable connecting device 8 is attached to the free end of straps 10A and 10B. The process of permanently attaching one end of a strap 10B to the fabric 4 can also be the means of simultaneously attaching the releasable connector 8 on the opposing side of the cover 14. Examples of such releasable connector devices 8 would be snaps and Velcro TM tape. Material for the straps 10A and 10B may be the same as the cover fabric 4 or other flexible non-abrasive material. It should be noted that while two narrow straps 10A and 10B have been indicated in FIG. 1, one skilled in the art might also use a variety of other means of attachment.

The lower area of the cover 14 as shown in FIG. 1 has somewhat the profile of the foot portion of an Eskimo muk-luk, displaying a toe are protruding out to the left with the heel area being on the right. Both FIG. 1 and FIG. 2 indicate a single elastic strip 6 sewn to the cover fabric 4 in a circulations route beginning adjacent to the outer edge of the cover 14 and proceeding to gradually move inward creating a skirt 12 that persists for approximately two thirds the total perimeter of the cover 14 ending once again adjacent to the edge and opposite from where it began. Attachment of the elastic 6 to the cover fabric 4 produces a gathering and puckering where the stitching occurs and creates a bag-like appearance of the encircled material.

Operation of Invention

From the above description of the gun cover 14, it should be apparent that it becomes a simple procedure to use the cover 14 on a gun with a telescopic slight 16.

First the user should lay the gun 16 across his lap with the barrel pointing to his left and the telescopic sight on the farside leaving the trigger on the nearside. Next, position the gun cover 14 so the upper portion, with the straps 10A and 10B, is adjacent to and parallel with the telescopic sight while keeping the toe side of the lower portion pointing to the left. Insert the free end of the straps between the telescopic sight and the action of the gun, staying between the mounting rings of the telescopic sight. Now the free end of the straps 10A and 10B can be pulled back over the top of the telescopic sight and attached back to the cover 14 with the releasable connector 8. At this point the gun 16 can be picked up and held in a normal carrying position by putting the left hand under the fore end of the gun 16 stock while the right hand graps the grip of the stock. By simply reaching down with the right hand and grasping the lower portion of the cover 14, the user can pull the cover 14 under, up and over the gun 16, stretching the elastic 6, in one wraparound motion without ever moving the left hand. The foregoing procedure is for right handed shooters using right handed guns. The cover 14 can also be used on left handed guns by left handed shooters. A left handed application is accomplished by first attaching the straps 10A and 10B exactly as described above. Then, instead of allowing the cover 14 to hang down on the left side of the gun 16 as shown in FIG. 1, pull the cover 14 up and over the telescopic sight making it hang down on the right side of the gun 16. Now the cover 14 can be used in a left handed manner, providing the same convenience that occurred in the right handed. It should also be noted that the self-adjusting elastic allows the cover to be used interchangeably between different guns having different sized telescopic sights.

Figure 2:
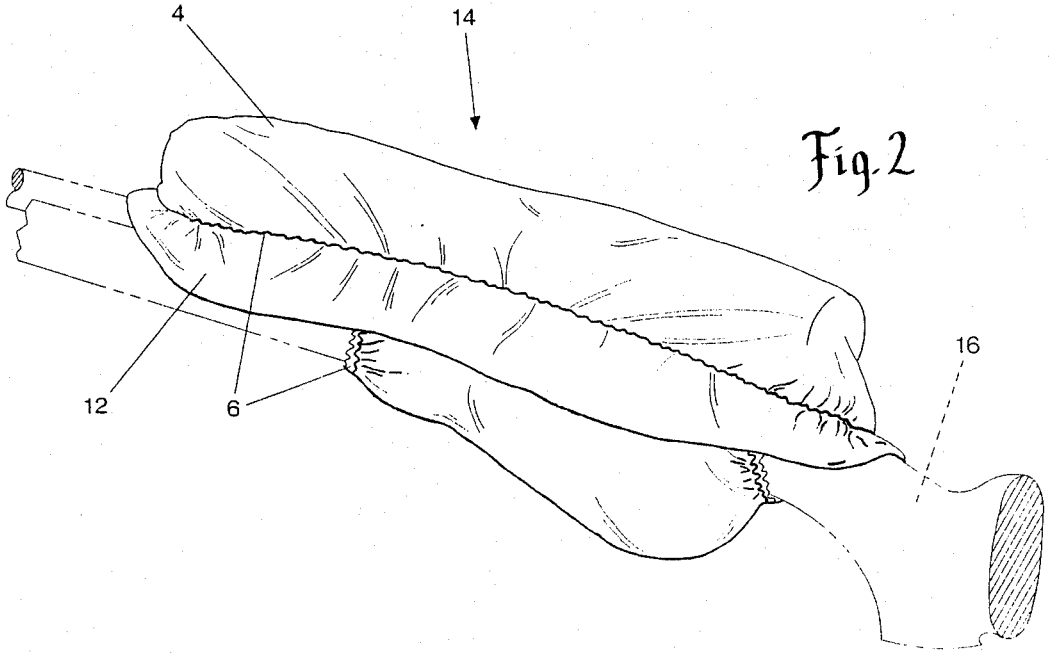
FIG. 2 is a perspective view showing the cover in the closed position.

When closed, the gun cover 14 shown in FIG. 2 provides complete protection to the sensitive and mechanical areas of a gun in a new and unexpected way.

Now the user is ready to carry the gun 16 into the field feeling confident she has good protection for her gun while at the same time knowing she can quickly and easily open the cover 14 by grasping the cover skirt 12 and simply reversing the closing movement. After opening the cover 14, the user can drop it's lower portion and quickly return his hand to the grip of the stock without being concerned about the location of the protective cover 14, thus allowing worry free firing and reloading even if the user is running over rough terrain.

Furthermore, the cover 14 can be used in extremely cold and miserable conditions while the user is wearing gloves. However, if conditions improve while the user has the cover 14 on his gun and he feels there is no longer a need for such protection, the cover 14 can easily be completely remmoved fro the gun 16 and stuffed into a clothing pocket and kept available for future use.

It will be clear to those skilled in the art, that many variations of my invention are possible within the spirit and scope of my invention. Accordingly, as I do not wish to be bound by the specific description of the preferred embodiment described above, the scope of the invention should be determined by the claims which follow, and their legal equivalents:

I claim:

1. A protective covering device for guns with telescopic sights comprising:

a one piece flexible cover unit made from an expanse of flexible material having a flat end portion on an intermediate flap portion connected to a pouch portion and being of sufficient size and shape to envelop the midsection of a gun including the trigger, action and telescopic sight when placed in a closed covering position;

attachment means for attaching said end portion of said cover unit to an intermediate portion of the telescopic sight of a gun and fixedly holding said end portion of said cover unit on the telescopic sight in juxtaposition to the gun with the cover unit located in an open non-covering position whereat the trigger and the action of the gun and the telescopic sight are uncovered and operable; and also fixedly holding said cover unit in a closed covering position whereat the trigger and action of the gun and the telescopic sight are completely covered and not operable; and stretchable resilient retaining and sealing means associated with said pouch portion of said cover unit for locating and retaining and sealing of said pouch portion over and around the top and both ends of the telescopic sight and for locating said flap portion in engagement with the midsection of the gun when the cover unit is in the closed covering position.

2. The invention as defined in claim 1 and wherein:

said stretchable resilient retaining and sealing means also being associated with said intermediate flap portion of said cover unit for retaining and sealing said flap portion relative to the action and trigger of the gun.

3. The invention as defined in claim 1 and wherein:

said stretchable resilient retaining and sealing means comprises at least one elongated elastic member attached to said flexible material.

4. The invention as defined in claim 2 and wherein:

said elastic member is comprised of an elastic strip integrally attached to said flexible material and defining a circuitous route along and bordering a skirted edge on said pouch portion of said flexible material thereby causing a retaining and sealing of said material about the said midsection of a gun when said cover unit is in the closed covering position.

5. The invention as defined in claim 4 and wherein:

said elastic member is stretched when said cover unit is in the closed covering position and therefore relaxed and shorter when said covering device is in the open non-covering position.

6. The covering device of claim 1 wherein said flexible material contains water impervious properties thereby making said covering device waterproof.

7. The covering device of claim 1 wherein said attachment means comprises at least one strap member attached to and extending from said end portion of said flexible cover unit; and having a length sufficient to provide a connecting loop extending around an intermediate portion of the telescopic sight.

8. The covering device of claim 7 wherein said attachment means further comprises a first releasable connector means on said strap member and a second releasable connector means on said end portion for releasably connecting said strap member to said end portion in looped relationship about the telescopic sight.

9. The covering device of claim 8 wherein said releasable connector means comprises hook and loop connecting devices.

10. The covering device of claim 9 wherein said first releasable connecting means being attached to the free end of said strap member and said second releasable connecting means being of considerably larger size and placed on said flap portion of said cover unit thereby allowing multiple adjustments of said strap member.

11. A cover for a rifle having an elongated stock, a trigger mechanism located along the bottom portion of the stock, and a telescopic sight mechanism mounted along the upper portion of the stock above the trigger mechanism; and comprising:

a one piece cover means for covering the trigger mechanism and the telescopic sight and being made of flexible sheet-like material and having a flap portion and a pouch portion;

said flat portion having a width shorter than the length of the telescopic sight and longer than the length of the trigger mechanism;

releasable fastening means on said flap portion for engagement with the attachment to the telescopic sight and releasably fastening the flap portion to the telescopic sight;

said pouch portion having an oval-shape central side wall section and a peripheral rim section providing an oval cavity therewithin of a size and shape such as to receive the entire telescopic sight mechanism therewithin; and resilient elastomeric retaining means on said pouch portion for resilient holding engagement with the telescopic sight mechanism and releasable retaining said pouch means in resilient holding engagement and full covering relationship with the telescopic sight mechanism.

12. Apparatus for covering a gun having an action, telescope sight and trigger, and comprising:

a one-piece cover means unit made of flexible waterproof material having a size and shape to enable covering of the midsection of the gun including the action, telescopic sight and trigger;

releasable attachment means for fixedly attaching the cover means to an intermediate portion of the telescopic sight and holding the cover means on the gun in both a covering position whereat the midsection of the gun including the action, telescopic sight and trigger are enclosed thereby and an uncovered position whereat the action, trigger and telescopic sight are uncovered for use in firing the gun; and expansible and contractable resilient mounting means on the periphery of said cover means for mounting said cover means in the covering position and being expansible to enable said cover means to be completely wrapped around the midsection of the gun and the telescopic sight apparatus in the covering position.

13. The invention as defined in claim 12 and wherein the cover means comprises:

pouch means with skirt means and an elastic band means for covering the telescopic sight with the elastic band means extending about the telescopic sight and the skirt means extending peripherally downwardly therefrom;

flap means extending downwardly from the releasable attachment means adjacent the telescopic sight and along one side of the gun stock and beneath and around the trigger mechanism and up the opposite side of the gun stock toward the telescopic sight apparatus; and the pouch means extending upwardly along one side and over the top and down the other side of the telescopic sight mechanism with the elastic band engaging the length of telescopic sight mechanism and holding the pouch portion about the telescopic mechanism.

* * * * *